US008781373B2

(12) United States Patent
Arai

(10) Patent No.: US 8,781,373 B2
(45) Date of Patent: Jul. 15, 2014

(54) IMAGE FORMING STRUCTURE, IMAGE FORMING APPARATUS, AND DEVELOPING DEVICE INCLUDING SHUTTER MEMBER

(75) Inventor: Masatoshi Arai, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 327 days.

(21) Appl. No.: 13/269,233

(22) Filed: Oct. 7, 2011

(65) Prior Publication Data

US 2012/0251186 A1 Oct. 4, 2012

(30) Foreign Application Priority Data

Mar. 28, 2011 (JP) ..... 2011-069711

(51) Int. Cl.
*G03G 15/08* (2006.01)

(52) U.S. Cl.
USPC ..... 399/260

(58) Field of Classification Search
USPC ..... 399/260, 262, 263
See application file for complete search history.

(56) References Cited

U.S. PATENT DOCUMENTS 5,325,163 A * 6/1994 Nishio ..... 399/106
2012/0020704 A1* 1/2012 Nishiyama ..... 399/262

FOREIGN PATENT DOCUMENTS

JP A-1-193872 8/1989
JP A-5-127524 5/1993
JP 2003066700 A * 3/2003
JP 2010032778 A * 2/2010

OTHER PUBLICATIONS

Computer translation of JP2010-032778A to Ito, pub Feb. 12, 2010.*

* cited by examiner

*Primary Examiner* — Quana M Grainger
(74) *Attorney, Agent, or Firm* — Oliff PLC

(57) ABSTRACT

An image forming structure includes an image holding member holding a latent image and an image obtained by developing the latent image, a developing device developing the latent image on the image holding member with a powder to form an image on the image holding member, a container mounting section demountably mounted with a container storing a powder to be supplied to the developing device, a shutter member that is disposed in a supply path including a powder introducing portion of the developing device and that blocks the supply path, and a supply member that is disposed at a position where the supply member engages with the shutter member and that rotates to supply the powder in a direction of a rotation shaft, wherein the supply member rotates to move the shutter member to an open position where the supply path is opened.

12 Claims, 15 Drawing Sheets

IMAGE FORMING STRUCTURE, IMAGE FORMING APPARATUS, AND DEVELOPING DEVICE INCLUDING SHUTTER MEMBER

CROSS-REFERENCE TO RELATED APPLICATIONS

This application is based on and claims priority under 35 USC 119 from Japanese Patent Application No. 2011-069711 filed Mar. 28, 2011.

BACKGROUND

Technical Field

The present invention relates to an image forming structure, an image forming apparatus, and a developing device.

SUMMARY

According to an aspect of the invention, there is provided an image forming structure including: an image holding member that holds a latent image, that is subjected to development with a powder, and that holds a developed image; a developing device that develops the latent image on the image holding member with the powder to form an image on the image holding member; a container mounting section that is demountably mounted with a container storing a powder to be supplied to the developing device; a shutter member that is disposed in a supply path extending from the container mounted on the container mounting section to the developing device and including a powder introducing portion of the developing device and that blocks the supply path; and a supply member that is disposed at a position where the supply member engages with the shutter member and that rotates to supply the powder in a direction of a rotation shaft, wherein the supply member rotates to move the shutter member to an open position where the supply path is opened.

BRIEF DESCRIPTION OF THE DRAWINGS

Exemplary embodiments of the present invention will be described in detail based on the following figures, wherein.

DETAILED DESCRIPTION

Hereinafter, exemplary embodiments of the invention will be described with reference to the accompanying drawings.

Overall Configuration of Image Forming Apparatus

Figure 1:
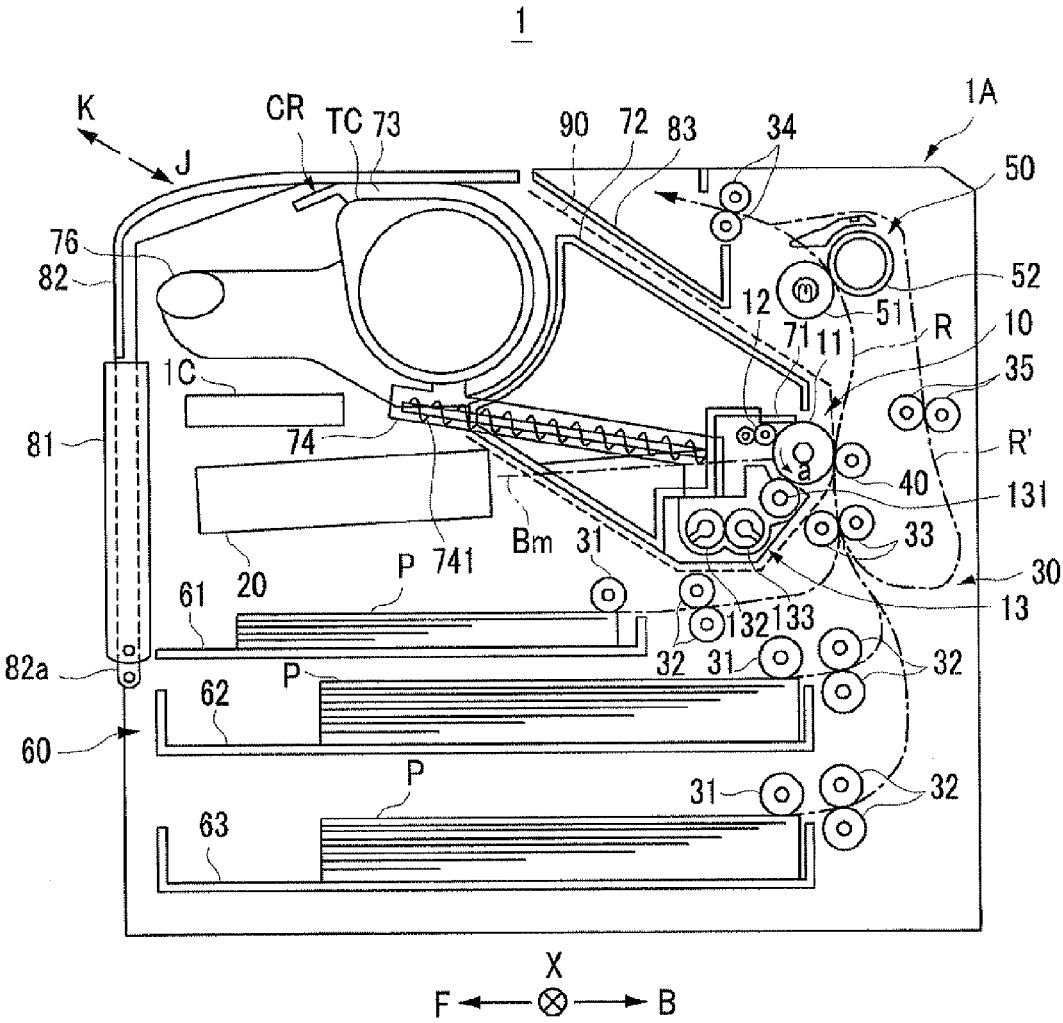
FIG. 1 is a sectional view schematically illustrating the configuration of an image forming apparatus according to an exemplary embodiment of the invention.

FIG. 1 is a sectional view schematically illustrating the configuration of an image forming apparatus according to an exemplary embodiment of the invention.

The image forming apparatus 1 shown in FIG. 1 is a printer that prints an image on a sheet of paper by the use of an electrophotographic method. The image forming apparatus 1 includes a toner image forming unit 10, an exposing device 20, a sheet transporting device 30, a transfer device 40, a fixing device 50, and a sheet storing unit 60. The toner image forming unit 10 includes a photosensitive member 11, a charging device 12, and a developing device 13.

The photosensitive member 11 has a cylindrical surface and rotates in the direction of arrow a around the cylinder center. The photosensitive member 11 holds an electrostatic latent image and a toner image formed on the surface. The charging device 12 charges the surface of the photosensitive member 11. The charging device 12 is a charging roll rotating in contact with the photosensitive member 11 in this example. In another example, a non-contact type charging device using a corotron may be employed.

The exposing device 20 exposes the photosensitive member 11 to form an electrostatic latent image on the photosensitive member 11. The exposing device 20 scans the surface of the photosensitive member 11 charged by the charging device 12 with a light beam Bm based on an image signal supplied from the outside to form a latent image on the surface of the photosensitive member 11. The exposing device 20 scans the surface of the photosensitive member 11 with a light beam Bm in the axial direction X in which the rotation shaft of the photosensitive member 11 extends.

The developing device 13 develops the latent image on the photosensitive member 11 with toner to form a toner image on the photosensitive member 11. The developing device 13 includes a developing roll 131 supplying a developer including toner and magnetic carriers to the photosensitive member 11. The internal structure of the developing device 13 will be described later.

The transfer device 40 is a roll rotating with a sheet of paper interposed between the photosensitive member 11 and the roll and transfers the toner image on the photosensitive member 11 to the sheet of paper. The fixing device 50 fixes the toner image transferred from the photosensitive member 11 to the sheet of paper. The fixing device 50 includes a heating roll 51 and a pressing roll 52 and heats and presses the toner by causing the sheet of paper having the toner image not fixed thereto to pass therebetween.

The sheet storing unit 60 stores sheets of paper on which images will be formed. The sheet storing unit 60 includes three sheet trays 61, 62, and 63 receiving three types of sheets of paper. Out of three sheet trays 61 to 63, the uppermost sheet tray 61 is exposed to the outside and is supplied with sheets of paper by opening a manual door 81 disposed on the front surface of the image forming apparatus 1 to the front side F.

The sheet transporting device 30 transports a sheet of paper along a transport path R passing through a transfer position. The transfer position is a position at which a toner image is transferred to a sheet of paper from the photosensitive member 11 and is also a position interposed between the photosensitive member 11 and the transfer device 40. The sheet transporting device 30 includes a pickup roll 31, a processing roll 32, a register roll 33, a discharge roll 34, and a reverse transport roll 35. The pickup roll 31 picks up sheets of paper from the sheet trays 61 to 63. The processing roll 32 processes the sheets of paper picked up by the pickup roll 31 sheet by sheet. The register roll 33 sends a sheet of paper to the transfer device 40 at a time point of forming a toner image on the photosensitive member 11. The discharge roll 34 discharges the sheet of paper to which the toner image is fixed by the fixing device 50 to the outside of the image forming apparatus 1. The sheet of paper discharged by the discharge roll 34 is discharged onto a discharge tray 83 disposed on the image forming apparatus 1. A part of the discharged sheet of paper protruding from the discharge tray 83 is placed on a door 82. The door 82 is a member covering the front surface and the top surface of the image forming apparatus 1. When the door 82 swings about a pivot 82*a* disposed on the front surface of the image forming apparatus 1 to the front side F, the inside of the image forming apparatus 1 is exposed. When a double-sided printing operation is performed, the discharge roll 34 reverses the sheet of paper midway and transports the sheet of paper along a reverse transport path R'. The reverse transport roll 35 transports the sheet of paper to the register roll 33 along the reverse transport path R'. Accordingly, a new image is formed on the opposite surface of the surface of the sheet of paper having an image formed thereon.

In the image forming apparatus 1 according to this exemplary embodiment, the sheet trays 62 and 63 are drawn out to the front side of the image forming apparatus 1 and are supplied with sheets of paper. In the image forming apparatus 1, the sheets of paper P supplied to the sheet trays 61 to 63 from the position on the front side F of the image forming apparatus 1 are basically transported upwards along the back part of the image forming apparatus 1, that is, along the transport path R disposed on the back side B of the photosensitive member 11. The sheet of paper P having an image formed thereon is discharged onto the discharge tray 83 on the image forming apparatus 1 to the front side F. In the image forming apparatus 1, the supply of new sheets of paper and the acquisition of the sheets of paper having an image formed thereon are carried out on the front side F of the apparatus by an operator. Therefore, the image forming apparatus may be installed in a place where no spatial margin is present on both sides in the axis direction X of the image forming apparatus 1. An image reader may be disposed on the image forming apparatus 1 with a gap, which is required for picking up a sheet of paper and replacing components, interposed therebetween.

The image forming apparatus 1 further includes a cleaning device 71, a recovered toner container 72, a container mounting section 73, a toner supplier 74, and a control unit 10.

The cleaning device 71 comes in contact with the photosensitive member 11 and cleans the photosensitive member 11 by removing the toner remaining on the photosensitive member 11 after the toner image is transferred to a sheet of paper. The cleaning device 71 is a plate-like blade extending along the photosensitive member 11. The recovered toner container 72 receives the toner removed from the photosensitive member 11 by the cleaning device 71. The container mounting section 73 is demountably mounted with a toner container (toner cartridge) TC. The toner container TC contains toner to be supplied to the developing device 13. When the toner is consumed, the toner container TC is detached and replaced with a new toner container TC by an operator.

The toner supplier 74 supplies the toner contained in the toner container TC to the developing device 13. The toner supplier 74 has a structure in which a blade member 741 having spiral blades is disposed in a tube extending from the bottom of the toner container TC to the top of the developing device 13. The toner supplier 74 supplies the toner from the toner container TC to the developing device 13 by causing the blade member 741 to rotate. The control unit 1C controls all units of the image forming apparatus 1.

The toner image forming unit 10, the cleaning device 71, the recovered toner container 72, the container mounting section 73, and the toner supplier 74 are disposed in a process cartridge CR. The process cartridge CR is detachably attached to an attachment section 90 disposed in the main body 1A of the image forming apparatus 1. The toner container TC is demountably mounted on the process cartridge CR. The process cartridge CR comes to the market in a state shown in FIG. 1 where it is attached to the image forming apparatus 1, or may come to the market as a single product in which the toner container TC is mounted as a replaceable product on the process cartridge CR. In the image forming apparatus 1, by opening the door 82 covering the front surface and the top surface to the front side F, the process cartridge CR is exposed from the image forming apparatus 1. More specifically, by opening the door 82, the container mounting section 73, the toner container TC, and a knob 76 of the process cartridge CR are exposed. When an operator pulls the knob 76, the process cartridge CR is drawn out from the main body 1A of the image forming apparatus 1 obliquely to the front side F, that is, in a detachment direction K. Here, the direction in which the process cartridge CR is attached to the main body 1A is referred to as an attachment direction J and the direction opposite to the attachment direction J is referred to as a detachment direction K. Both directions of the attachment direction J and the detachment direction K are referred to as attachment and detachment directions JK.

Here, the process cartridge CR corresponds to an example of the image forming structure in the invention and the developing device 13 corresponds to an example of the developing device in the invention. The photosensitive member 11 corresponds to an example of the image holding member in the invention and the developing roll 131 corresponds to an example of the developing member in the invention. The toner corresponds to an example of the powder in the invention.

Basic Operation of Image Forming Apparatus

The basic operation of the image forming apparatus 1 shown in FIG. 1 will be described below. In the toner image forming unit 10, the photosensitive member 11 is rotationally driven in the direction of arrow a and electric charges are given to the surface of the photosensitive member 11 by the charging device 12. The exposing device 20 applies exposing light based on an image signal supplied from the outside to the surface of the photosensitive member 11 to form an electrostatic latent image on the surface of the photosensitive member 11. The photosensitive member 11 rotates while holding the electrostatic latent image.

The developing device 13 develops the electrostatic latent image on the photosensitive member 11 with the toner to form a toner image. The developing device 13 is supplied with toner from the toner container TC by the toner supplier 74. The photosensitive member 11 rotates while holding the toner image formed by the developing device 13.

The sheets of paper P received in the sheet trays 61, 62, and 63 are picked up by the pickup roll 31 and are transported to the transfer device 40 along the transport path R by the processing roll 32 and the register roll 33. A sheet of paper P is transported to the transfer device 40 to correspond to the time point of forming a toner image on the photosensitive member 11 by the register roll 33. The transfer device 40 transfers the toner image on the photosensitive member 11 to the sheet of paper by applying a transfer bias voltage across the photosensitive member 11 and the sheet of paper. The sheet of paper to which the toner image is transferred by the transfer device 40 is transported to the fixing device 50 and the transferred toner image is fixed to the sheet of paper. In this case, an image is formed on the sheet of paper. The sheet of paper having an image formed thereon is discharged to the discharge tray 83 by the discharge roll 34.

The toner remaining on the photosensitive member 11 after the transfer in the transfer device 40 is removed by the cleaning device 71. The toner removed from the photosensitive member 11 by the cleaning device 71 is contained in the recovered toner container 72.

Configuration of Process Cartridge

Figure 2:
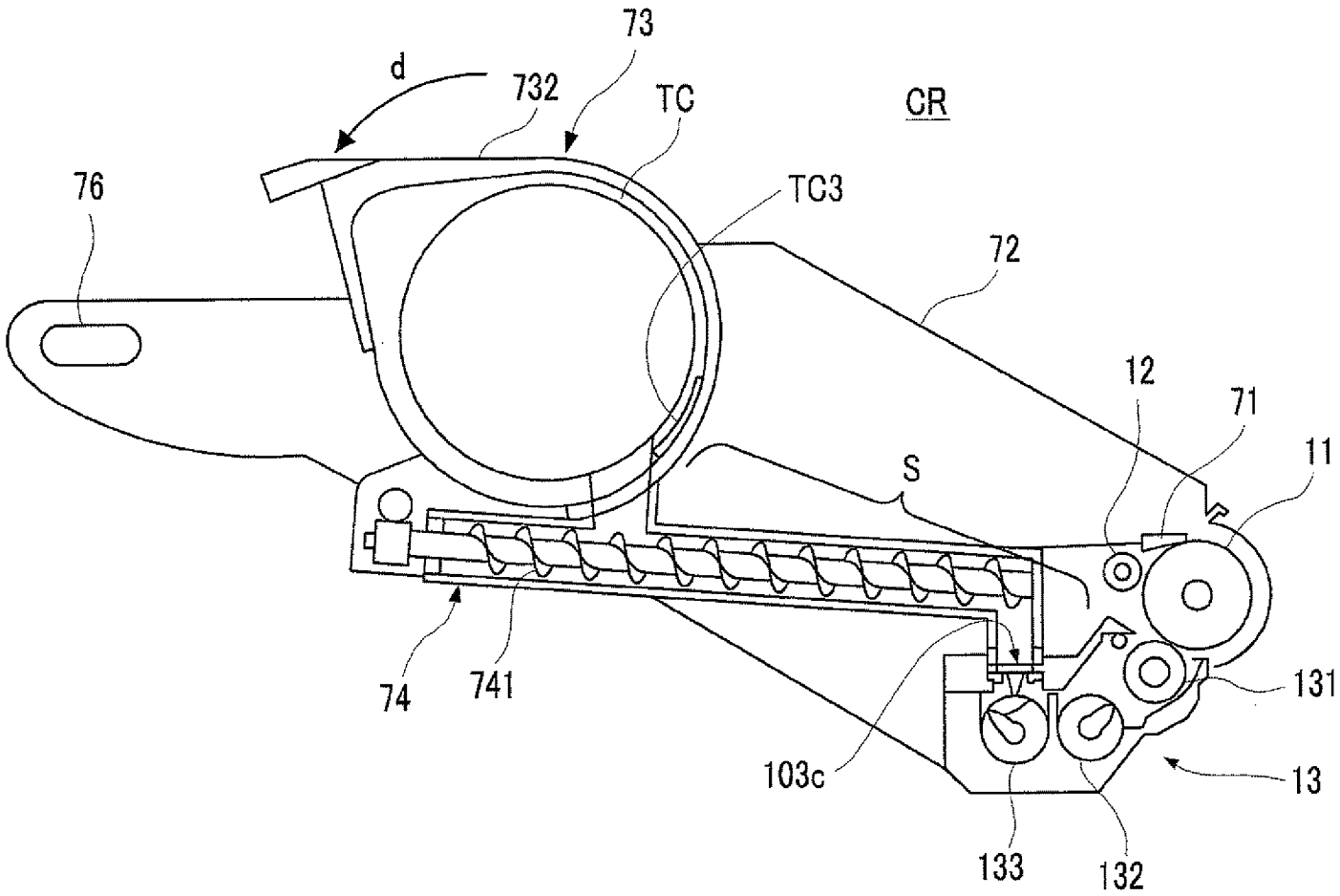
FIG. 2 is a sectional view illustrating the configuration of a process cartridge.

FIG. 2 is a sectional view illustrating the configuration of the process cartridge.

The process cartridge CR is a replaceable unit in which the toner image forming unit 10, the cleaning device 71, the recovered toner container 72, the container mounting section 73, the toner supplier 74, and the knob 76 are incorporated into a body. The toner image forming unit 10 includes the photosensitive member 11, the charging device 12, and the developing device 13. In the image forming apparatus 1 (see FIG. 1), when the process cartridge CR is replaced, all of the photosensitive member 11, the charging device 12, the developing device 13, the cleaning device 71, and the recovered toner container 72 are replaced with new ones. Since the toner container TC is demountably mounted on the container mounting section 73 of the process cartridge CR, the toner container is detached from the container mounting section 73 and is replaced with a new one in a state where the process cartridge CR is attached to the main body 1A (see FIG. 1).

Figure 3:
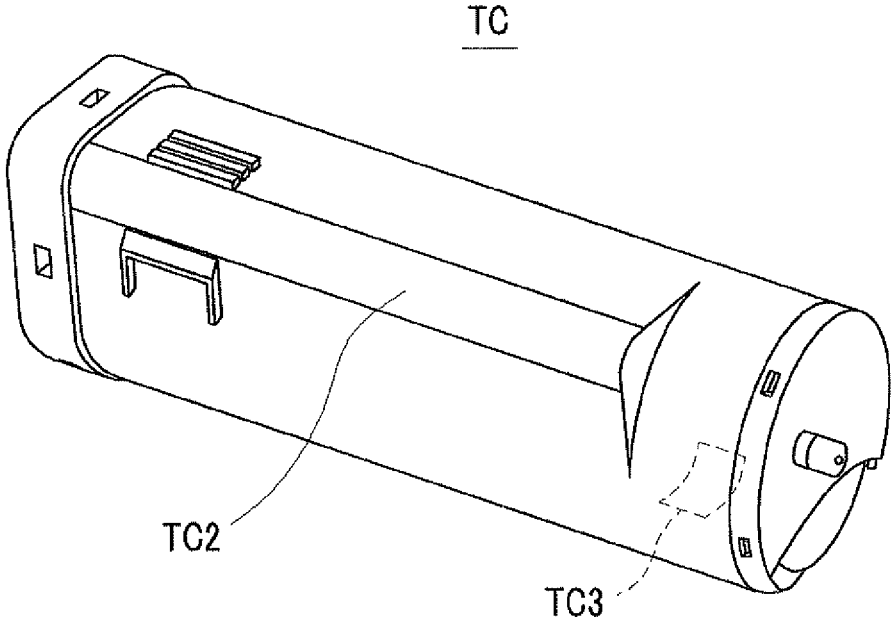
FIG. 3 is a perspective view illustrating a toner container.

FIG. 3 is a perspective view illustrating the toner container.

The toner container TC shown in FIG. 3 has a bottomed cylindrical shape in which a protrusion TC2 indicating the direction of the toner container TC is formed in a part of a side surface thereof and contains toner therein. A door TC3 blocking the passage of the toner is disposed on the peripheral surface of the toner container TC.

The process cartridge CR will be subsequently described with reference to FIG. 2.

A binding member 732 having a bottomed cylindrical shape in which a part of the peripheral surface is missed is rotatably held in the container mounting section 73 of the process cartridge CR. When the binding member 732 is operated to rotate to the state shown in FIG. 2 in the direction of arrow d from the state where the toner container TC is received in the binding member 732, the toner container TC is bound to the container mounting section 73. At this time, the door TC3 engages with the binding member 732 and moves to a position where the passage is opened. Accordingly, the toner in the toner container TC is dropped to the toner supplier 74 and can be supplied by the toner supplier 74.

The image forming apparatus 1 comes to the market in the state shown in FIG. 2 where the process cartridge CR is attached to the main body 1A (see FIG. 1) of the image forming apparatus 1 and the toner container TC is mounted on the process cartridge CR. That is, the image forming apparatus comes to the market in the state where the door TC3 (see FIG. 3) of the toner container TC is located at the position where the passage is opened and the toner in the toner container TC is dropped to the toner supplier 74. This is true of the case where a replaceable process cartridge CR comes to the market as a single product.

when the process cartridge CR coming to the market is received by vibration based on transport or vibration based on installation before it is started up, the toner dropped from the toner container TC moves in the toner supplier 74 even without the rotation of the blade member 741. When the toner flows in the developing device 13 in a stopped state, the toner may be condensed in the developing device 13, thereby causing a defect in an image to be formed. In the process cartridge CR according to this exemplary embodiment, a mechanism for preventing the inflow of toner before it is started up is disposed in the developing device 13.

Developing Device

Figure 4:
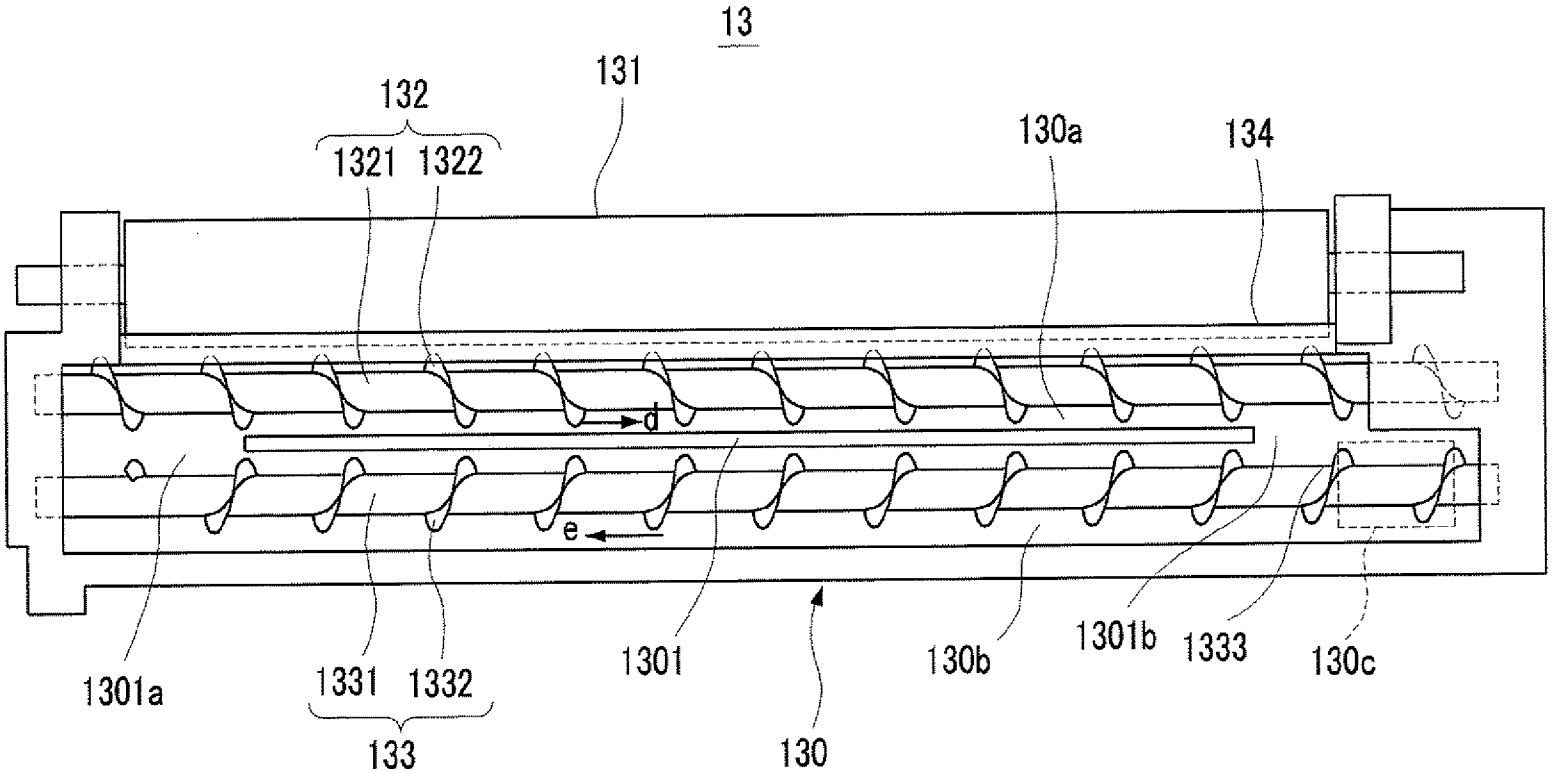
FIG. 4 is a view illustrating a developing device shown in FIG. 2 when seen from the upside.

FIG. 4 is a diagram illustrating the developing device shown in FIG. 2 as seen from the upside. A state where the cover member is removed from the top of the developing device 13 is shown in FIG. 4.

The developing device 13 shown in FIGS. 2 and 4 includes a developer container 130 containing a developer, a developing roll 131, a first agitation and supply member 132 and a second agitation and supply member 133 agitating and transporting the developer in the developer container 130, and a developer restricting member 134.

The developer container 130 contains the developer in which toner and magnetic carriers are mixed. The inside of the developer container 130 is divided into a first container chamber 130*a* and a second container chamber 130*b* by a partition wall 1301 extending in parallel to the developing roll 131. The first container chamber 130*a* is adjacent to the developing roll 131 and the second container chamber 130*b* is disposed on the opposite side of the developing roll 131 about the first container chamber 130*a*. The first agitation and supply member 132 is disposed in the first container chamber 130*a* and the second agitation and supply member 133 is disposed in the second container chamber 130*b*. A toner supply port 130*c* opened to the upside is disposed at an end of the second container chamber 130*b*.

The two agitation and supply members 132 and 133 include rotation shafts 1321 and 1331 extending in parallel to the developing roll 131 and spiral blades 1322 and 1332 disposed around the rotation shafts 1321 and 1331, respectively. The spiral blade 1332 of the second agitation and supply member 133 and the spiral blade 1322 of the first agitation and supply member 132 have opposite rotation directions. Both ends of the rotation shafts 1321 and 1331 of the first agitation and supply member 132 and the second agitation and supply member 133 are rotatably supported by the developer container 130 through the use of bearings not shown. The ends of the rotation shafts 1321 and 1331 are connected to gears not shown and the developing roller 131 and the two agitation and supply members 132 and 133 are rotationally driven by the use of a motor not shown.

Figure 5:
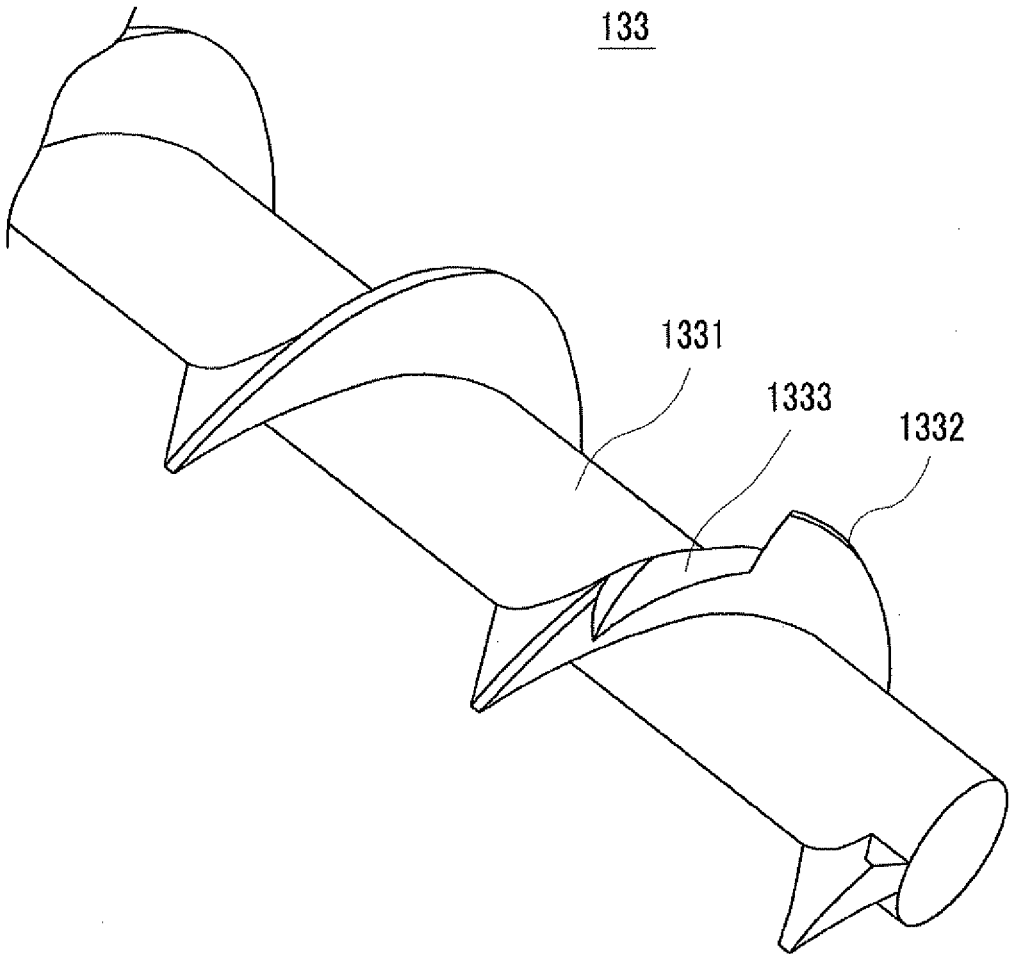
FIG. 5 is a perspective view illustrating a second agitation and supply member shown in FIG. 4 in a state where it is taken out of the developing device.

FIG. 5 is a perspective view illustrating a state where the second agitation and supply member shown in FIG. 4 is taken out of the developing device.

In the second agitation and supply member 133, the spiral blade 1332 is disposed around the rotation shaft 1331 and a cutout 1333 is formed in the spiral blade 1332. The function of the cutout 1333 will be described later. The cutout 1333 shown in FIG. 5 is disposed in the second agitation and supply member 133 and is not disposed in the first agitation and supply member 132 (see FIG. 4).

Referring to FIG. 4 again, the first agitation and supply member 132 supplies the developer in the first container chamber 130*a* in a first supply direction indicated by arrow d by rotating around the rotation shaft 1321. The second agitation and supply member 133 supplies the developer in the second container chamber 130*b* in a second supply direction, which is opposite to the first supply direction, indicated by arrow e by rotating around the rotation shaft 1331 in the same direction as the first agitation and supply member 132.

Circulation ports 1301*a* and 1301*b* are disposed in the partition wall 1301 partitioning the first container chamber 130*a* and the second container chamber 130*b* and the developer contained in the developer container 130 circulates along the partition wall 1301 via the circulation ports 1301*a* and 1301*b*.

The developing roll 131 rotates while holding the developer in the first container chamber 130*a* with the peripheral surface thereof. The developer on the peripheral surface of the developing roll 131 is restricted in height (thickness) by the developer restricting member 134 and is supplied to the peripheral surface of the photosensitive member 11. The toner of the developer is attached to the electrostatic latent image on the photosensitive member 11 to form a toner image. The components other than the toner attached to the peripheral surface out of the developer supplied to the photosensitive member 11 are held by the peripheral surface of the developing roll 131 and are returned to the first container chamber 130*a*. New toner corresponding to the toner consumed by the developing is supplied from the toner supplier 74 via the toner supply port 130*c*.

Shutter Member

Figure 6:
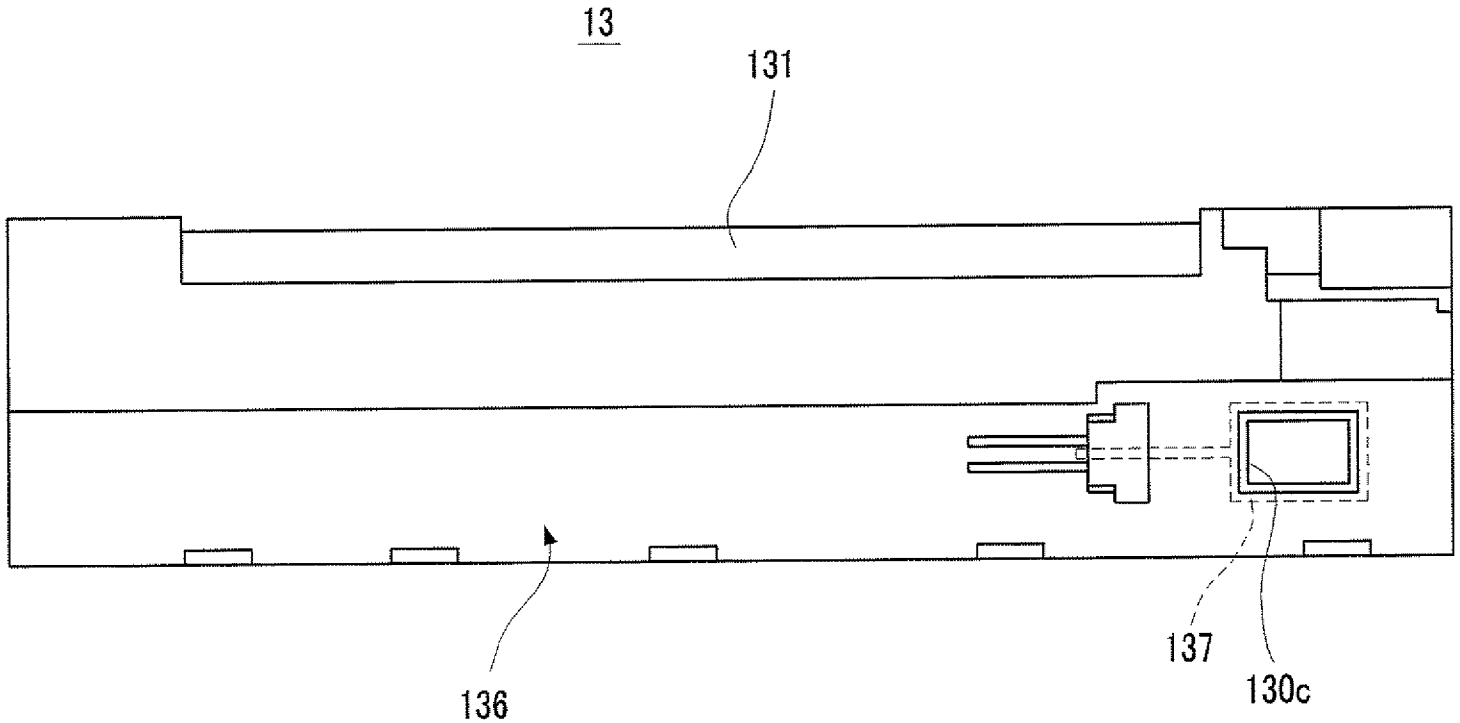
FIG. 6 is a plan view illustrating a state where a cover member is mounted on the developing device shown in FIG. 4.

FIG. 6 is a plan view illustrating a state where the cover member is mounted on the developing device shown in FIG. 4.

A part of the developing roll 131 is exposed from the edge of the cover member 136 shown in FIG. 6. The toner supply port 130*c* is formed in the cover member 136 and a shutter member 137 is mounted thereon. The shutter member 137 is disposed in the toner supply port 130*c* in the toner supply path S extending from the toner container TC shown in FIG. 2 to the developing device 13. In the state shown in FIG. 6, the shutter member 137 is located at a shut position where the toner supply port 130*c* is covered.

Figure 7:
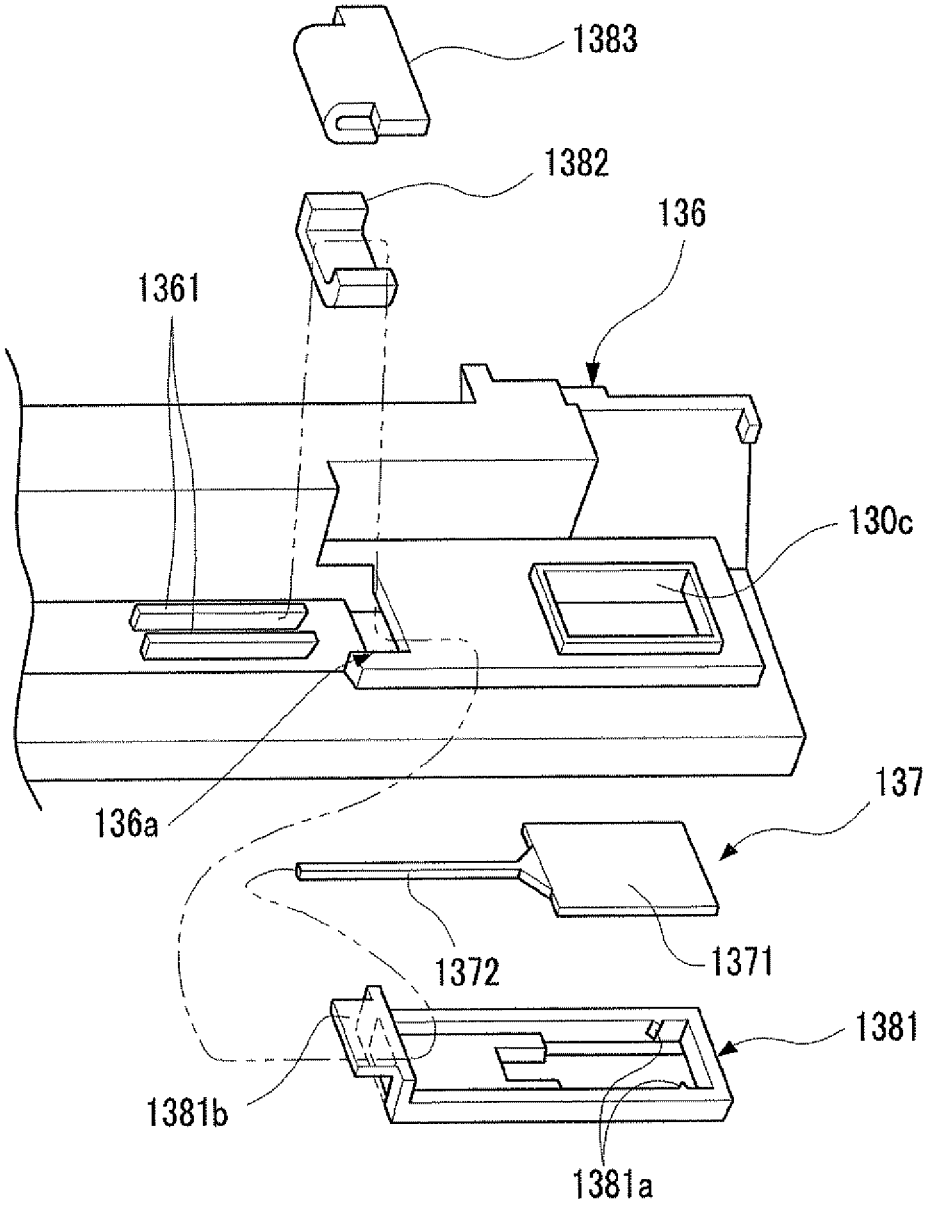
FIG. 7 is an exploded perspective view illustrating components mounted on the cover member shown in FIG. 6.

FIG. 7 is an exploded perspective view illustrating components mounted on the cover member shown in FIG. 6.

In addition to the shutter member 137, a pressing member 1381, a first leakage preventing member 1382, and a second leakage preventing member 1383 are disposed around the toner supply port 130*c* of the cover member 136.

The cover member 136, the shutter member 137, and the pressing member 1381 are molded products formed of a resin material. Two leakage preventing members 1382 and 1383 are members formed of sponge.

The pressing member 1381 and the shutter member 137 are disposed to face the developer 13, that is, on the side of the cover member 136 facing the second agitation and supply member 133 (see FIG. 4). The pressing member 1381 is disposed at a position where the shutter member 137 is held with the shutter member interposed between the cover member 136 and the pressing member. The pressing member 1381 includes protrusions 1381*a* and a protruding piece 1381*b*. The protrusion 1381*a* and the protruding piece 1381*b* will be described later.

The shutter member 137 interposed between the cover member 136 and the pressing member 1381 is supported to be movable between a position where the toner supply port 130*c* is shut and a position where the toner supply port 130*c* is opened. As shown in FIG. 7, the shutter member 137 includes a plate portion 1371 shutting the toner supply port 130*c* and an indication rod 1372 protruding in a linear rod shape from a part of the edge of the plate portion 1371.

Figure 8:
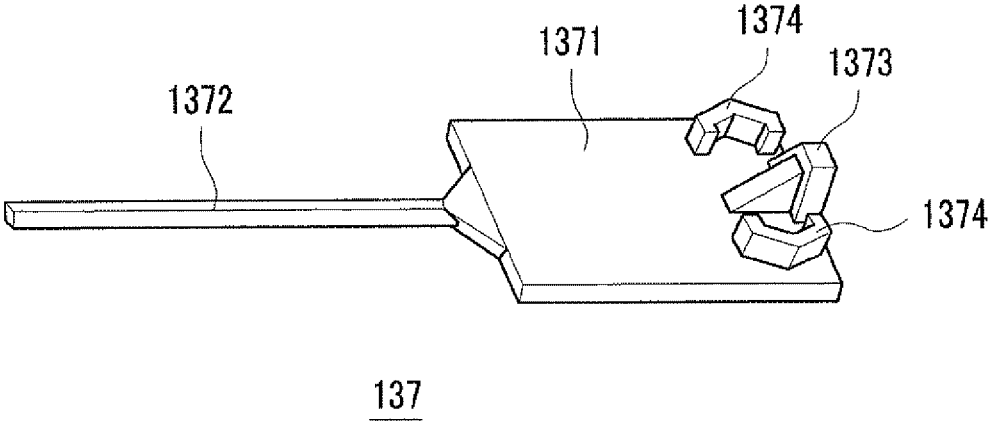
FIG. 8 is a perspective view illustrating a back surface of a shutter member shown in FIG. 7.

FIG. 8 is a perspective view illustrating the back surface of the shutter member shown in FIG. 7.

The shutter member 137 shown in FIGS. 7 and 8 includes a plate portion 1371 shutting the toner supply port 130*c* and an indication rod 1372 protruding in a linear rod shape from a part of the edge of the plate portion 1371. The plate portion 1371 is provided with an engaging protrusion 1373 protruding to the second agitation and supply member 133 (see FIG. 4) and locking pieces 1374 protruding in the same direction as the engaging protrusion 1373 in the vicinity of both sides with the engaging protrusion 1373 interposed therebetween. The plate portion 1371, the indication rod 1372, the engaging protrusion 1373, and the locking pieces 1374 of the shutter member 137 are formed as a single body.

Figure 9:
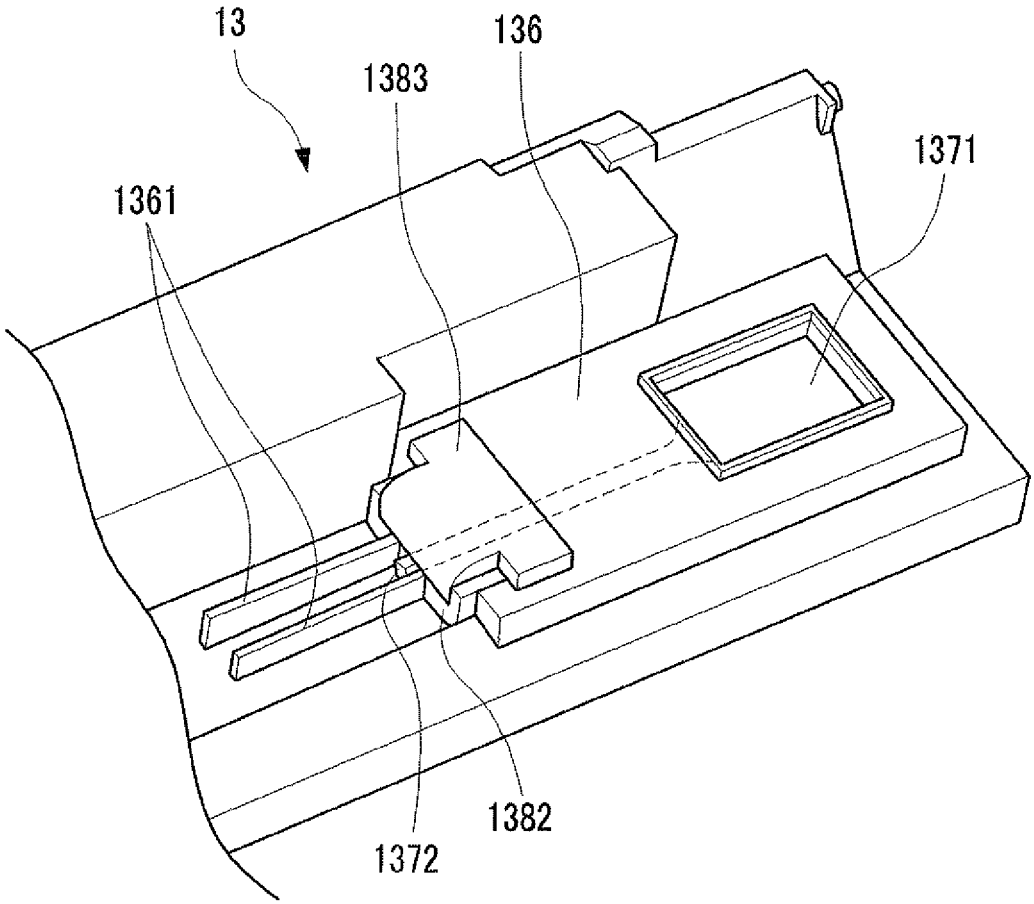
FIG. 9 is a perspective view illustrating the periphery of a toner supply port of the cover member shown in FIG. 6.
Figure 10:
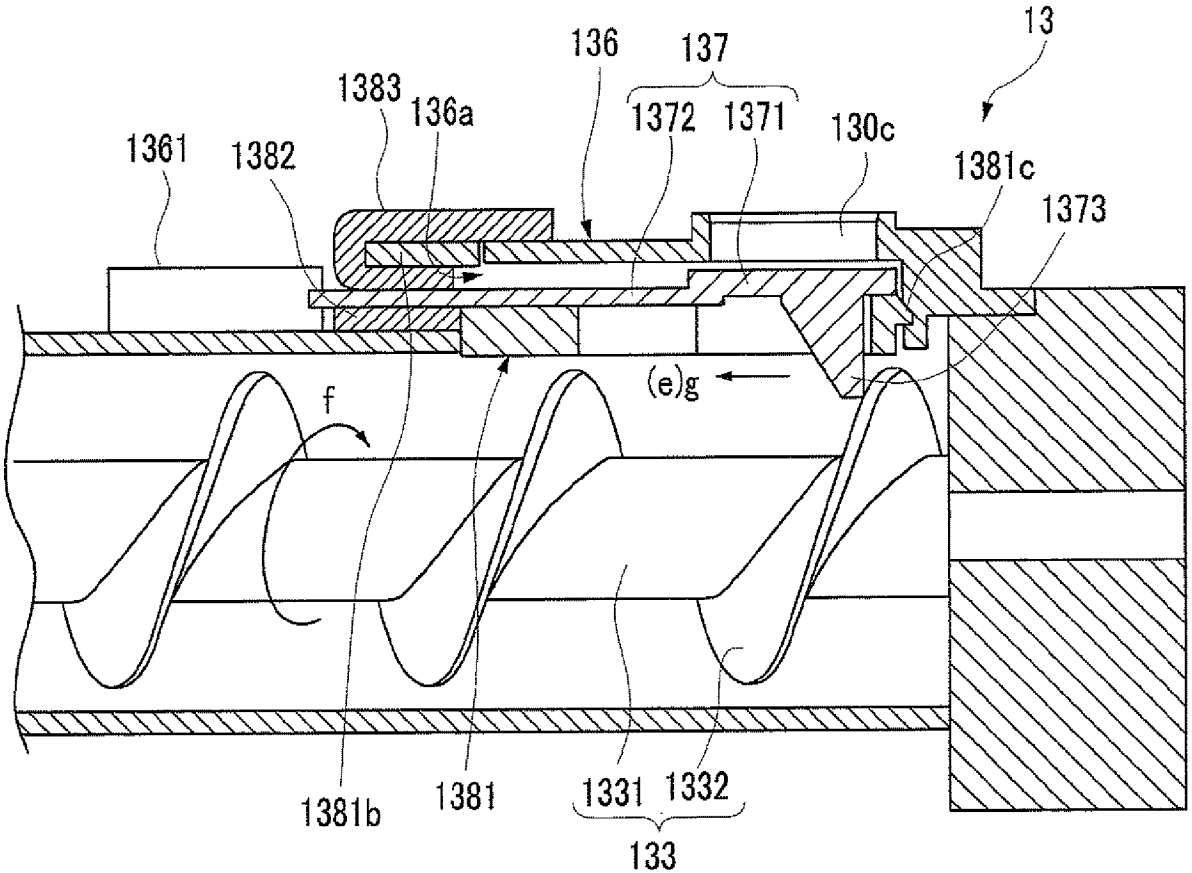
FIG. 10 is a sectional view illustrating the internal structure of the developing device in the vicinity of the toner supply port.

FIG. 9 is a perspective view illustrating the vicinity of the toner supply port of the cover member shown in FIG. 6. A state where the components shown in FIG. 7 are mounted on the cover member 136 is shown in FIG. 9. FIG. 10 is a sectional view illustrating the internal structure in the vicinity of the toner supply port of the developing device. The internal structure in a state where the cover member 136 shown in FIG. 9 with the components mounted on the cover member 136 is mounted on the developer container 130 is shown in FIG. 10. In FIG. 10, a side surface instead of the sectional surface is shown for the purpose of easy understanding the shape of the agitation and supply member 133.

In FIG. 10, the pressing member 1381 interposing the shutter member 137 between the cover member 136 and the pressing member is shown. The protruding piece 1381*b* protruding from a flank hole 136*a* disposed in the vicinity of the toner supply port 130*c* of the cover member 136 to the outside of the developing device 13 is formed in the pressing member 1381. The protruding piece 1381*b* is inserted into the second leakage preventing member 1383. A hooking piece 1381*c* hooked on the cover member 136 is disposed at an end of the pressing member 1381 opposite to the protruding piece 1381*b*. The pressing member 1381 is supported by the cover member 136 by so-called snap-fit fixation in which the protruding piece 1381*b* passing through the flank hole 136*a* is pressed towards the flank hole 136*a* and the hook piece 1381*c* is hooked on the cover member 136.

The indication rod 1372 of the shutter member 137 slightly protrudes from the flank hole 136*a* of the cover member 136 to the outside of the developing device 13. The end of the indication rod 1372 arrives between a pair of protective walls 1361. The pair of protective walls 1361 are ribs extending substantially in parallel with a gap through which the indication rod 1372 passes. The indication rod 1372 and the protective walls 1361 extend in the second supply direction e.

In the vicinity of the flank hole 136*a*, the indication rod 1372 is vertically interposed between the first leakage preventing member 1382 and the second leakage preventing member 1383. The gap of the flank hole 136*a* of the cover member 136 through which the indication rod 1372 passes is covered with the first leakage preventing member 1382 and the second leakage preventing member 1383, thereby preventing the toner in the developing device 13 from leaking from the flank hole 136*a*.

As shown in FIG. 10, the engaging protrusion 1373 of the shutter member 137 protrudes from the plate portion 1371 towards the second agitation and supply member 133 (downward in FIG. 10) and extends to the rotation region of the spiral blade 1332. That is, the engaging protrusion 1373 extends to the position corresponding to the spiral blade 1332 when the second agitation and supply member 133 rotates.

Holding Portion

Figure 11:
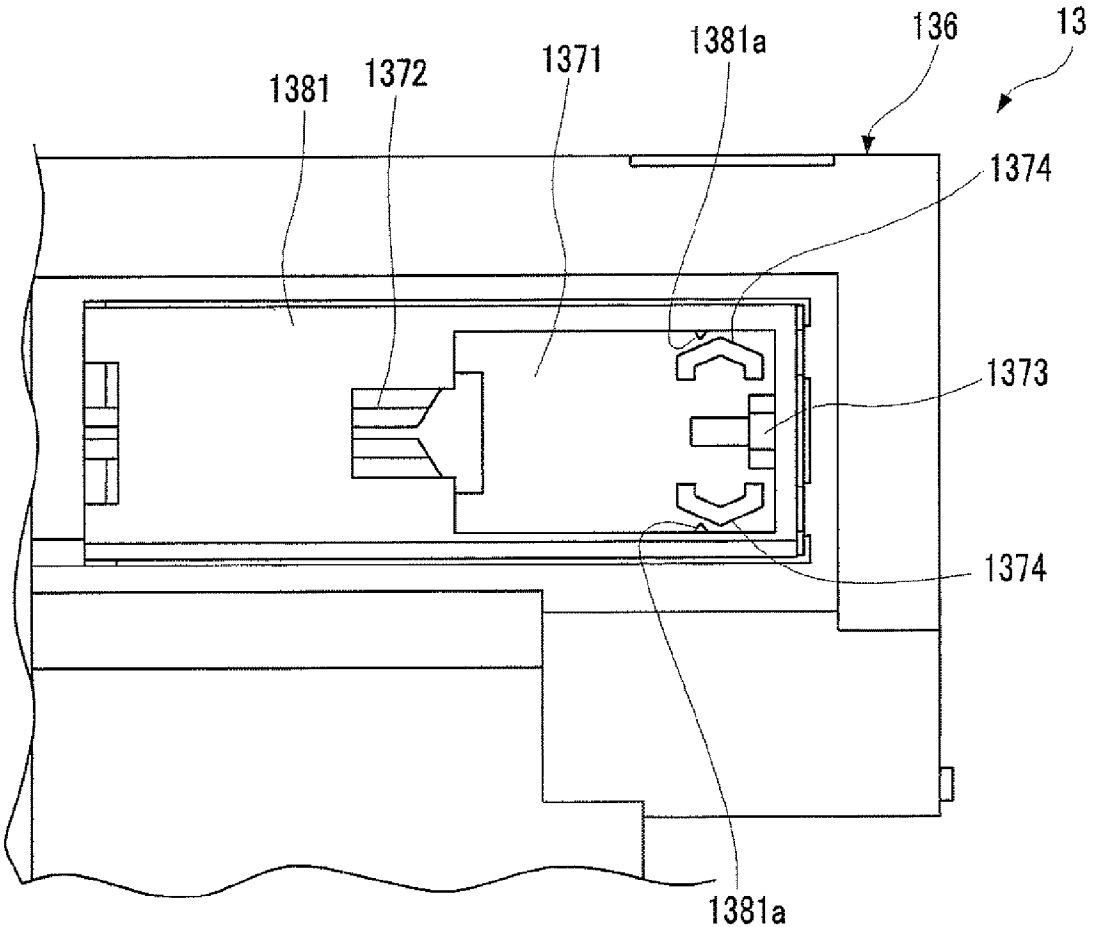
FIG. 11 is a diagram illustrating the periphery of the toner supply port of the cover member shown in FIG. 9 when seen from the side of the second agitation and supply member.

FIG. 11 is a diagram illustrating the periphery of the toner supply port of the cover member shown in FIG. 9 when seen from the downside, that is, the side of the second agitation and supply member.

A pair of locking pieces 1374 is disposed on both sides of the engaging protrusion 1373 protruding from the plate portion 1371 of the shutter member 137. A pair of protrusions 1381*a* is disposed in the path of the pressing member 1381 through which the engaging protrusion 1373 passes with the movement of the shutter member 137.

The shutter member 137 is held at the shut position by bringing the engaging protrusion 1373 into contact with the protrusions 1381*a*. Accordingly, the careless opening of the toner supply path is suppressed. However, when a force for moving against the reaction force between the engaging protrusion 1373 and the protrusions 1381*a* is applied to the shutter member 137, the engaging protrusion 1373 goes over the protrusions 1381*a* and the shutter member 137 thus moves from the shut position.

Here, the indication rod 1372 corresponds to an example of the protruding piece in the invention. The engaging protrusion 1373 and the protrusions 1381*a* correspond to an example of the holding portion in the invention. The second agitation and supply member 133 corresponds to an example of the toner supply member in the invention. The combination of the developer container 130 and the cover member 136 corresponds to an example of the housing in the invention.

Movement of Shutter Member

The process cartridge CR (see FIG. 2) having the developing device 13 comes to the market in a state where it is attached to the image forming apparatus 1 (see FIG. 1) with the shutter member 137 of the developing device 13 located at the shut position where the toner supply port 130*c* is covered, as shown in FIGS. 9 and 10. At the time of shipment, the toner container TC containing the toner is mounted on the process cartridge CR with the door TC3 (see FIG. 3) opened.

The process cartridge CR (see FIG. 1) as a replaceable component comes to the market as a single product. In this case, the toner container TC containing the toner is mounted on the replaceable process cartridge CR with the door TC3 (see FIG. 3) opened. At the time of shipment, the shutter member 137 of the developing device 13 is located at the shut position where the toner supply port 130*c* is covered, as in the state where it is attached to the image forming apparatus 1 (see FIG. 1).

The toner in the toner container TC is dropped to the toner supplier 74 and gradually moves in the toner supplier 74 after shipment, more specifically, before starting its use after the toner container TC is mounted at the factory. In the process cartridge CR according to this exemplary embodiment, since the shutter member 137 of the developing device 13 is located at the shut position where the toner supply port 130*c* is covered, the toner moving in the toner supplier 74 is blocked by the shutter member 137 and does not enter the developing device 13. Therefore, the agitation and supply members 132 and 133 in the developing device 13 before starting its use do not operate, but the toner is not condensed in the developing device 13.

Here, when the replaceable process cartridge CR or the image forming apparatus 1 having the process cartridge CR attached thereto comes to the market, is installed in a use place, and is supplied with power (or when at least image data is supplied from the outside), the units of the image forming apparatus 1 is started up under the control of the control unit 1C. The blade member 741 starts its rotation in the toner supplier 74. The agitation and supply members 132 and 133 start their rotation in the developing device 13 (see FIG. 4).

The second agitation and supply member 133 moves the shutter member 137 (see FIG. 10) by the rotation at the time of first starting up. More specifically, as shown in FIG. 10, when the second agitation and supply member 133 rotates in the direction indicated by arrow f, the spiral blade 1332 comes into contact with the engaging protrusion 1373 of the shutter member 137 and applies a force in the direction indicated by arrow g in which the rotation shaft extends to the shutter member 137 with the rotation of the second agitation and supply member 133. The shutter member 137 is pushed to move in the direction indicated by arrow g by the spiral blade 1332. The direction of arrow f in which the second agitation and supply member 133 rotates is the same as the direction in which the second agitation and supply member 133 rotates to supply the developer at the time of performing a developing operation, and the direction of arrow g in which the shutter member 137 moves is the second supply direction e (see FIG. 4) in which the second agitation and supply member 133 supplies the developer.

As described with reference to FIG. 11, the protrusions 1381*a* are disposed in the pressing member 1381 and the locking pieces 1374 of the shutter member 137 comes into contact with the protrusion 1381*a* at the time of moving. The second agitation and supply member 133 causes the shutter member 137 to move against the reaction force by which the locking pieces 1374 and the protrusions 1381 press each other. At this time, the locking pieces 1374 or the protrusions 1381*a* are elastically deformed and the locking pieces 1374 go over the protrusions 1381*a*.

Figure 12:
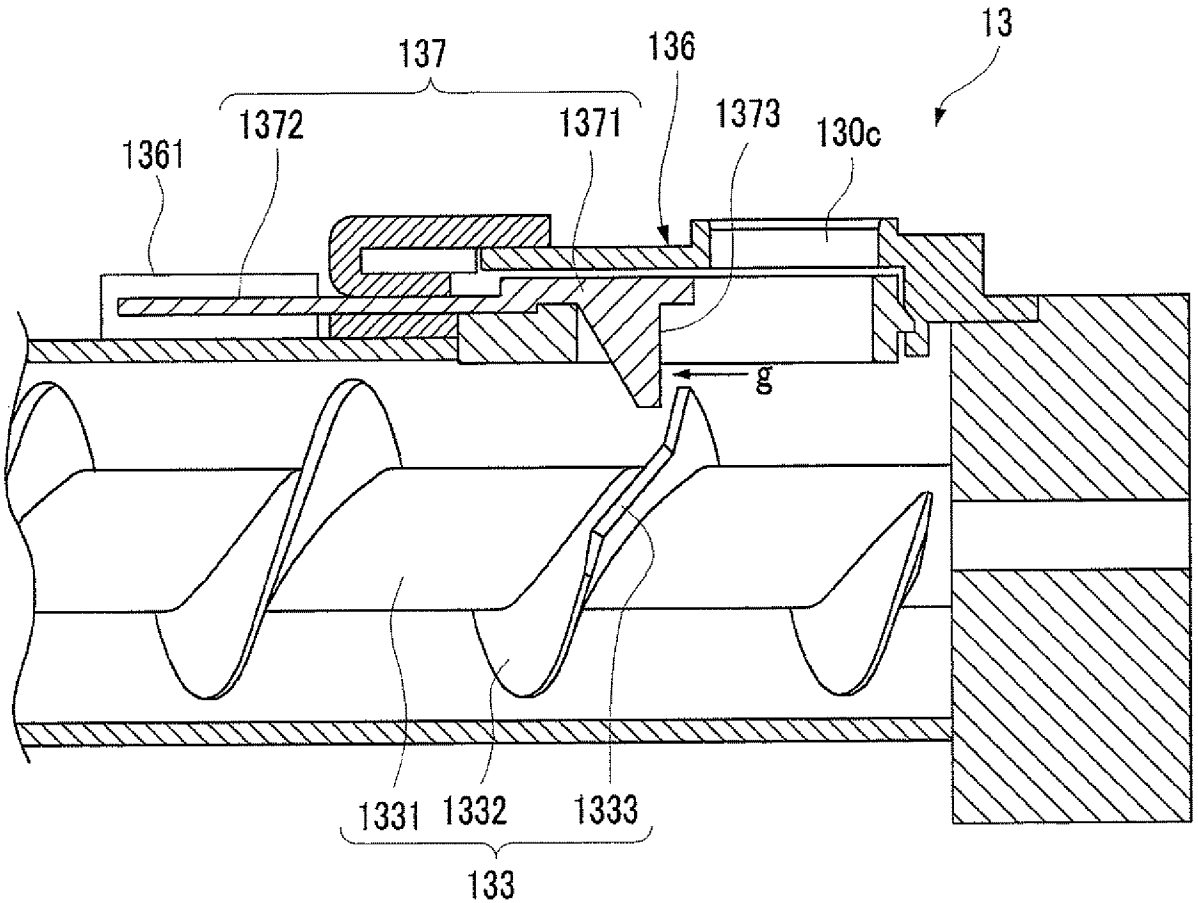
FIG. 12 is a sectional view illustrating a state where the shutter member opens the toner supply port.
Figure 13:
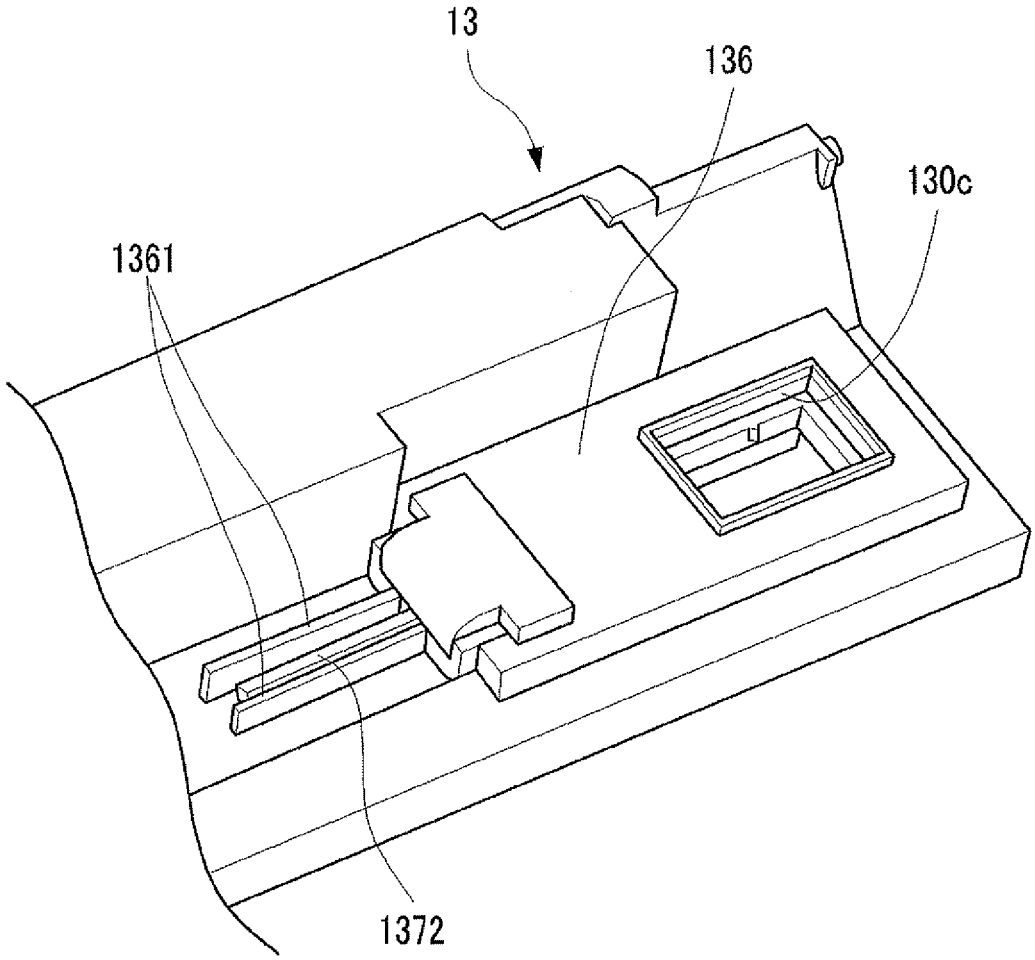
FIG. 13 is a perspective view illustrating a state where the shutter member opens the toner supply port.

FIG. 12 is a sectional view illustrating a state where the shutter member opens the toner supply port. FIG. 13 is a perspective view illustrating the state where the shutter member opens the toner supply port.

When the second agitation and supply member 133 causes the shutter member 137 to further move, the plate portion 1371 of the shutter member 137 moves to the open position where the toner supply port 130*c* is opened, which is shown in FIG. 12. By causing the shutter member 137 to open the toner supply port 130*c*, the toner supply path S (see FIG. 2) is opened, and the toner enters the developing device 13 and is used for developing. With the movement of the shutter member 137 to the open position, the indication rod 1372 of the shutter member 137 protrudes to the outside of the cover member 136. That is, the length of the indication rod 1372 as viewed from the outside increases. The indication rod 1372 extends in the same length as a pair of protective walls 1361. Accordingly, it is seen from the outside of the developing device 13 that the toner supply port 130*c* is opened. Since the indication rod 1372 is a rod incorporated into the shutter member 137, the indication rod 1372 can be used to return the shutter member 137 to the shut position in addition to displaying the moving state to the open position. For example, when the second agitation and supply member 133 rotates to cause the shutter member 137 to move unexpectedly or unintentionally before starting its use for the reasons of adjustment for shipment and the like, an operator in the factory can reversely rotate the second agitation and supply member 133 and push the indication rod 1372 from the outside of the developing device 13, whereby the shutter member 137 is returned to the shut position. The indication rod 1372 is disposed between a pair of protective walls 1361. Accordingly, when the process cartridge CR is detached, for example, for the purpose of maintenance, the indication rod 1372 is prevented from coming in careless contact with other members to return the shutter member 137 to the shut position.

As shown in FIG. 12, the cutout 1333 disposed in the spiral blade 1332 of the second agitation and supply member 133 is located at a position where the engaging protrusion 1373 is disengaged from the spiral blade 1332 when the shutter member 137 moves to the open position shown in FIG. 12. Accordingly, the driving of the shutter member 137 due to the spiral blade 1332 is ended when it moves to the open position, and is thus stopped at the open position.

In this way, since the shutter member 137 opens the toner supply port 130*c* with the rotation of the second agitation and supply member 133 at the time of first starting up, an image forming operation is started without causing an operator to open the path extending from the toner container TC to the developing device 13 before starting its use.

The toner container TC is replaced whenever the contained toner is consumed up. Accordingly, the toner container is replaced and recycled at a relatively high frequency, for example, compared with a process cartridge CR to be replaced depending on the lifetime of the photosensitive member 11 or the like. In order to suppress the increase in complexity and cost of the toner container TC which is replaced and recycled at a high frequency, it can be thought that a member shutting the path of toner before starting its use and a mechanism opening the member without requiring an operator's operation are disposed in the process cartridge CR instead of the toner container TC. However, in this case, it is necessary to newly dispose the opening mechanism outside the toner container TC.

In this exemplary embodiment, the second agitation and supply member 133 supplying and agitating the toner in the developing device 13 also has a function of a drive source opening the shutter member 137. Therefore, only by forming the shutter member 137 in the shape in which the engaging protrusion 1373 protrudes, the mechanism driving the shutter member 137 is formed. As a result, the number of components is smaller and the size of the driving mechanism is also smaller, for example, compared with the case where any particular opening mechanism is provided. The shutter member 137 or the engaging protrusion 1373 is disposed in the developing device 13 instead of the toner container and is disposed in the upper part of the second container chamber 130*b* (see FIG. 4) not interfering with the flow of toner supplied in the developing device 13. Accordingly, the capacity of the toner container is greater, for example, compared with the case where the member preventing the movement of toner or the driving mechanism thereof is disposed in the toner container.

In this exemplary embodiment, since the cutout 1333 is disposed in the spiral blade 1332, the shutter member 137 does not move to the end of the second agitation and supply member 133 and stops at the position of the cutout 1333. The position where the shutter member 137 stops is set to a predetermined open position by adjusting the position of the cutout 133 at the time of designing and manufacturing. Since the shutter member 137 is not driven after it moves to the open position, the driving load of the second agitation and supply member 133 after it is opened is reduced.

Second Exemplary Embodiment

A second exemplary embodiment of the invention will be described below. In the second exemplary embodiment, the same elements as in the above-mentioned exemplary embodiment are referenced by the same reference numerals and signs and differences from the above-mentioned exemplary embodiment will be described.

Figure 14:
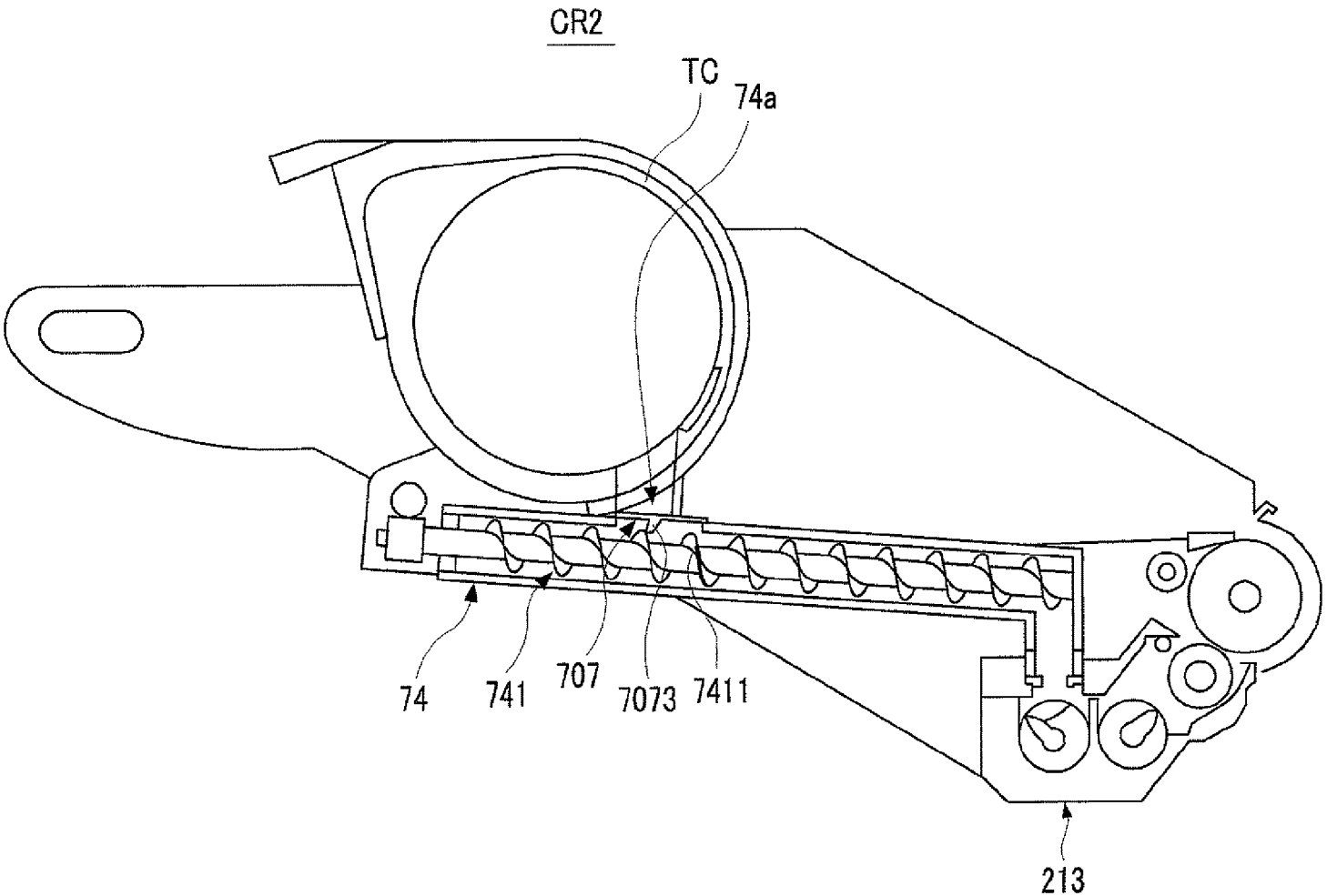
FIG. 14 is a sectional view illustrating the configuration of a process cartridge according to a second exemplary embodiment of the invention.

FIG. 14 is a sectional view illustrating the configuration of a process cartridge according to the second exemplary embodiment of the invention.

In the process cartridge CR2 according to this exemplary embodiment, a shutter member 707 is not disposed in the developing device 213 but in the toner supplier 74. A cutout 7411 is formed in the blade member 741 of the toner supplier 74.

The shutter member 707 is disposed in the upper part of the toner supplier 74, that is, in a supply port 74*a* through which toner is supplied to the toner supplier 74 from the toner container TC. The shutter member 707 has the same shape as the shutter member 137 in the first exemplary embodiment described with reference to FIGS. 7 and 8. The engaging protrusion 7073 disposed in the shutter member 707 protrudes to a position where it engages with the blade member 741.

Here, the blade member 741 of the toner supplier 74 corresponds to an example of the toner supply member in the invention.

The shutter member 707 is located at a shut position where the supply port 74*a* through which the toner from the toner container TC passes is shut in the state where the process cartridge CR2 comes to the market. Accordingly, the toner in the toner container TC is prevented from entering the developing device 213 and being condensed therein due to vibration before starting up the process cartridge CR2 after shipment thereof. In this exemplary embodiment, the toner does not enter the toner supplier 74.

Figure 15:
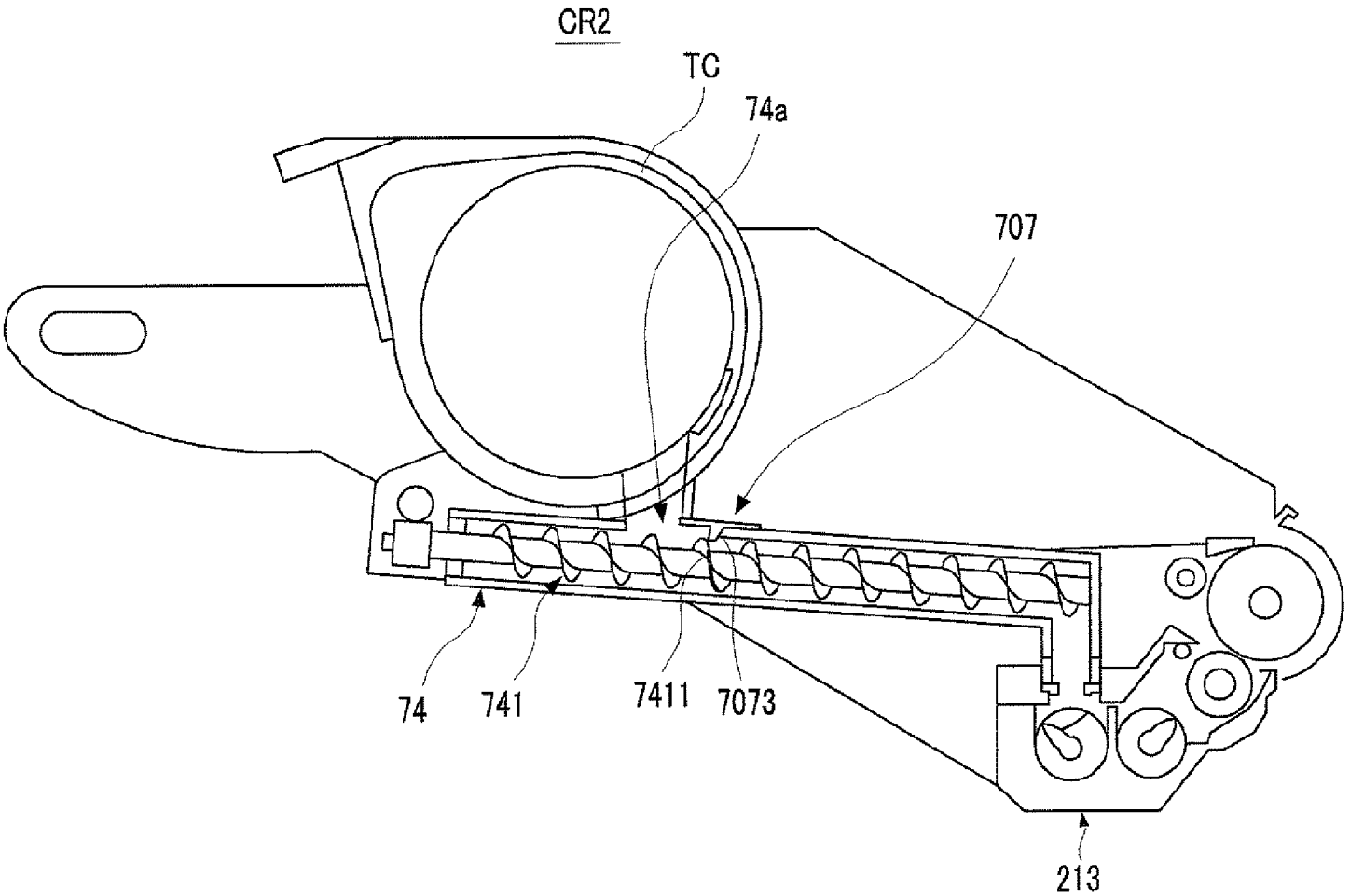
FIG. 15 is a sectional view illustrating a state where the shutter member moves in the process cartridge shown in FIG. 14.

FIG. 15 is a sectional view illustrating a state where the shutter member moves in the process cartridge shown in FIG. 14.

When the process cartridge CR2 is started up, the blade member 741 of the toner supplier 74 starts its rotation. Then, the blade member 741 engages with the engaging protrusion 7073 of the shutter member 707 and caused the shutter member 707 to the open position where the supply port 74*a* is opened. The cutout 7411 of the blade member 741 is disposed at the position of the engaging protrusion 7073 when the shutter member 707 moves to the open position. Accordingly, the engagement between the blade member 741 and the engaging protrusion 7073 is released by the cutout 7411 and the shutter member stays at the open position.

According to the process cartridge CR, an image forming operation is started without causing an operator to open the path extending from the toner container TC to the developing device 13 before starting its use.

In the process cartridge CR according to this exemplary embodiment, the blade member 741 has a function of rotating to supply the toner and a function as a drive source driving the shutter member 707. Therefore, the number of components is smaller and the size of the driving mechanism is smaller, for example, compared with the case where any particular driving member or device is additionally provided. The capacity of the toner container is greater, for example, compared with the case where the member preventing the movement of toner or the driving mechanism thereof is disposed in the toner container. Since the shutter member 707 is stopped at a predetermined open position by the cutout 7411, the load of the second agitation and supply member 133 is reduced.

In the above-mentioned exemplary embodiments, the second agitation and supply member 133 or the blade member 741 having a cutout formed therein is described as the toner supply member in the invention. However, the invention is not limited to this configuration, but the toner supply member may not have an cutout and the shutter member may move obliquely about the direction of the rotation shaft of the toner supply member and may be separated from the toner supply member.

In the above-mentioned exemplary embodiments, the photosensitive member 11 having a cylindrical surface is described as an example of the image holding member in the invention. However, the invention is not limited to this configuration, but the image holding member may have a belt shape.

In the above-mentioned exemplary embodiments, the configuration in which a toner image on the photosensitive member 11 is directly transferred to a sheet of paper is described as an example of the image forming unit in the invention. However, the invention is not limited to this configuration, but a toner image on the image holding member may be indirectly transferred to a sheet of paper via an intermediate transfer member.

In the above-mentioned exemplary embodiments, a monochromatic printer is described as an example of the image forming apparatus. However, the image forming apparatus in the invention is not limited to the monochromatic printer, but may be a color printer forming a color image.

In the above-mentioned exemplary embodiments, a printer is described as an example of the image forming apparatus. However, the image forming apparatus in the invention is not limited to the printer, but may be a copier or a facsimile.

In the above-mentioned exemplary embodiments, two-component developing toner is described as an example of the powder. However, the powder in the invention is not limited to the two-component developing toner, but may be a one-component developing toner.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming structure comprising:

an image holding member (1) that holds a latent image, (2) that is subjected to development with a powder, and (3) that holds a developed image;

a developing device that develops the latent image on the image holding member with the powder to form an image on the image holding member;

a container mounting section that is demountably mounted with a container storing a powder to be supplied to the developing device;

a shutter member (i) that is disposed in a supply path, extending from the container mounted on the container mounting section to the developing device and including a powder introducing portion of the developing device, and (ii) that blocks the supply path; and a supply member that is disposed at a position where the supply member engages with the shutter member and that rotates to supply the powder in an axial direction of a rotation shaft of the supply member, wherein the supply member rotates to move the shutter member in the axial direction of the rotation shaft in which the powder is supplied to an open position where the supply path is opened.

2. The image forming structure according to claim 1, wherein the supply member includes a spiral blade, wherein the supply member rotates and presses the shutter member with the spiral blade to move the shutter member to the open position, and wherein the spiral blade includes a cutout disengaging the spiral blade from the shutter member moving to the open position.

3. An image forming structure comprising:

an image holding member (1) that holds a latent image, (2) that is subjected to development with a powder, and (3) that holds a developed image;

a developing device that develops the latent image on the image holding member with the powder to form an image on the image holding member;

a container mounting section that is demountably mounted with a container storing a powder to be supplied to the developing device;

a shutter member (i) that is disposed in a supply path, extending from the container mounted on the container mounting section to the developing device and including a powder introducing portion of the developing device, and (ii) that blocks the supply path;

a supply member that is disposed at a position where the supply member engages with the shutter member and that rotates to supply the powder in a direction of a rotation shaft; and a housing that defines at least a part of the supply path and that receives the shutter member therein, wherein the supply member rotates to move the shutter member to an open position where the supply path is opened, and wherein the shutter member includes a protruding piece protruding out of the housing with the movement to the open position.

4. The image forming structure according to claim 2, further comprising:

a housing that defines at least a part of the supply path and that receives the shutter member therein, wherein the shutter member includes a protruding piece protruding out of the housing with the movement to the open position.

5. The image forming structure according to claim 1, further comprising:

a holding portion that holds the shutter member at a shut position where the supply path is blocked, wherein the supply member causes the shutter member located at the shut position to move to the open position against a reaction force of the holding portion.

6. The image forming structure according to claim 2, further comprising:

a holding portion that holds the shutter member at a shut position where the supply path is blocked, wherein the supply member causes the shutter member located at the shut position to move to the open position against a reaction force of the holding portion.

7. The image forming structure according to claim 3, further comprising:

a holding portion that holds the shutter member at a shut position where the supply path is blocked, wherein the supply member causes the shutter member located at the shut position to move to the open position against a reaction force of the holding portion.

8. The image forming structure according to claim 4, further comprising:

a holding portion that holds the shutter member at a shut position where the supply path is blocked, wherein the supply member causes the shutter member located at the shut position to move to the open position against a reaction force of the holding portion.

9. An image forming apparatus comprising:

the image forming structure according to claim 1;

an image forming structure mounting section on which the image forming structure is demountably mounted;

a transfer device that transfers an image on the image holding member to a transfer medium; and a fixing device that fixes the image transferred to the transfer medium to the transfer medium.

10. A developing device comprising:

a housing that contains a powder and that includes a port receiving a powder supplied from outside;

a powder supply member that is disposed at a position where the powder supply member engages with a shutter member and that rotates to supply the powder in the housing in an axial direction of a rotation shaft of the powder supply member; and a developing member that develops a latent image on an image holding member with the powder, wherein the powder supply member rotates to move the shutter member in the axial direction of the rotation shaft in which the powder is supplied to an open position where the port is opened.

11. The image forming structure according to claim 1, wherein the shutter member is downstream in the supply path of the container mounting section and the container.

12. The image forming structure according to claim 1, wherein the supply member is downstream in the supply path of the shutter member.

* * * * *